US011060315B2

(12) United States Patent
Lafoux et al.

(10) Patent No.: US 11,060,315 B2
(45) Date of Patent: Jul. 13, 2021

(54) FOLDABLE TENT COMPRISING TWO UMBRELLA STRUCTURES

(71) Applicant: DECATHLON, Villeneuve d'Ascq (FR)

(72) Inventors: Benjamin Lafoux, Villeneuve d'Ascq (FR); Alexandre Genero, Villeneuve d'Ascq (FR)

( * ) Notice: Subject to any disclaimer, the term of this patent is extended or adjusted under 35 U.S.C. 154(b) by 0 days.

(21) Appl. No.: 16/654,115

(22) Filed: Oct. 16, 2019

(65) Prior Publication Data

US 2020/0123802 A1 Apr. 23, 2020

(30) Foreign Application Priority Data

Oct. 17, 2018 (FR) ..... 18 59616

(51) Int. Cl.

| | |
|---|---|
| ***E04H 15/28*** | (2006.01) |
| ***E04H 15/48*** | (2006.01) |
| *A45B 19/00* | (2006.01) |
| *E04H 15/18* | (2006.01) |

(52) U.S. Cl.

CPC ..... *E04H 15/28* (2013.01); *E04H 15/48* (2013.01); *A45B 2019/005* (2013.01); *E04H 15/18* (2013.01)

(58) Field of Classification Search

CPC ..... E04H 15/18; E04H 15/26; E04H 15/28; E04H 15/34; E04H 15/405; E04H 15/48; E04H 15/44; E04H 15/36; A45B 2019/005; A45B 23/00; A45B 2200/1072; A45B 2023/0093

See application file for complete search history.

(56) References Cited

U.S. PATENT DOCUMENTS 990,632 A * 4/1911 Burton ..... A45B 25/02 135/20.1
2,864,389 A * 12/1958 Smith ..... E04H 15/28 135/98

(Continued)

FOREIGN PATENT DOCUMENTS

DE 19808133 A1 8/1998
EP 0819809 A1 * 1/1998 ..... E04H 15/28

(Continued)

OTHER PUBLICATIONS

English translation of WO 2014/128382 from espacenet.com.*

(Continued)

*Primary Examiner* — David R Dunn
*Assistant Examiner* — Danielle Jackson
(74) *Attorney, Agent, or Firm* — Yasser Mourtada; Robert Facey; William Salinger

(57) ABSTRACT

A foldable tent is disclosed. The foldable tent comprises a roof having a tent canvas, a first mastless umbrella structure, a second mastless umbrella structure, and at least a first junction configured to connect in a hinged manner the distal end of a first rib of the first umbrella structure and the distal end of a first rib of the second umbrella structure, the foldable tent being able to assume a deployed position in which the first and second umbrella structures are in the open position and a folded position in which the first and second umbrella structures are in the closed position.

20 Claims, 8 Drawing Sheets

(56) References Cited

U.S. PATENT DOCUMENTS

| | | | | | |
|---|---|---|---|---|---|
| 3,464,431 | A * | 9/1969 | Loeffler | A45B 11/00 | 135/20.1 |
| 3,941,140 | A | 3/1976 | Beavers | | |
| 4,026,312 | A * | 5/1977 | Beavers | E04H 15/48 | 135/147 |
| 4,077,417 | A * | 3/1978 | Beavers | E04H 15/48 | 135/121 |
| 4,144,900 | A * | 3/1979 | Kinski | A45B 11/00 | 135/20.1 |
| 4,274,429 | A * | 6/1981 | Kinski | A45B 11/00 | 135/20.1 |
| 4,941,499 | A * | 7/1990 | Pelsue | E04H 15/42 | 135/125 |
| 7,793,674 | B2 * | 9/2010 | Elder | A45B 25/20 | 135/33.2 |
| 7,918,236 | B2 * | 4/2011 | Elder | A45B 25/20 | 135/33.2 |
| 7,958,904 | B2 * | 6/2011 | Lau | A01M 31/025 | 135/147 |
| 8,104,494 | B2 * | 1/2012 | Elder | A45B 11/00 | 135/33.2 |
| 10,251,801 | B2 * | 4/2019 | Breegi | A61F 7/0053 | |
| D866,948 | S * | 11/2019 | Yang | D3/5 | |
| 10,563,423 | B1 * | 2/2020 | Bird | E04H 15/48 | |
| 10,767,387 | B2 * | 9/2020 | Bird | E04H 15/642 | |
| 2009/0084420 | A1 * | 4/2009 | Pelsue | E04H 15/48 | 135/96 |
| 2013/0008478 | A1 * | 1/2013 | Prieto Estebanez | E04H 15/32 | 135/147 |
| 2016/0074268 | A1 * | 3/2016 | Breegi | A61G 11/009 | 600/21 |
| 2020/0048925 | A1 * | 2/2020 | Cooper | E04H 15/001 | |

FOREIGN PATENT DOCUMENTS

| | | | | |
|---|---|---|---|---|
| FR | 2582339 | A1 | 11/1986 | |
| GB | 2482745 | B | 2/2012 | |
| WO | 2010/139162 | A1 | 12/2010 | |
| WO | 2014/128382 | A1 | 8/2014 | |
| WO | WO-2019164714 | A1 * | 8/2019 | E04H 15/48 |

OTHER PUBLICATIONS

English language abstract of FR 2582339.
English language abstract of DE 19808133.
English language abstract of WO 2014/128382.

* cited by examiner

FOLDABLE TENT COMPRISING TWO UMBRELLA STRUCTURES

BACKGROUND

The present disclosure concerns the field of camping equipment. More specifically, the disclosure relates to a foldable tent that can assume a folded position corresponding to a storage position, and a deployed position corresponding to a use position.

This type of tents is commonly used by hikers and campers. Indeed, the foldable tents can be quickly deployed or folded, allowing the installation or quick storage of a bivouac.

Foldable tents are known, such as the one described in document U.S. Pat. No. 3,941,140. This tent comprises a first sub-frame and a second sub-frame, each of the sub-frames comprising a plurality of rods pivotally connected to a hub. The two sub-frames form two rectangles inclined towards each other in order to define the interior volume of the tent.

A disadvantage of this tent is that it has a particularly small interior volume that does not provide the necessary comfort to the user. The head and the feet of a user lying in the foldable tent may in particular touch the tent canvas, which is particularly unpleasant and affects the ability of the user to sleep.

In addition, to place the tent in the deployed position, it is necessary to manually pivot each of the rods relative to the corresponding hub, in order to form the two sub-frames. These rods must be manually pivoted, one after the other. Since the tent comprises eight rods, the installation of the tent therefore turns out to be long and complicated. In addition, the force to be produced for pivoting said rods can become particularly significant because of the tension exerted by the tent canvas on the already pivoted rods.

Similarly, to store this tent, it is necessary to pivot the rods again, in a second direction, in order to bring each of the sub-frames in a folded position. Again, the forces to be exerted for pivoting the rods can be significant. In addition, the user must move gradually all around the tent in order to reach each of the rods, which is tiring and does not allow folding up the tent quickly. The storage of the tent is therefore very long and complicated, not very instinctive and may cause fatigue to the user.

SUMMARY

The present disclosure proposes a foldable tent overcoming the aforementioned problems.

To do so, the disclosure relates to a foldable tent comprising a roof having:

a tent canvas;

a first mastless umbrella structure including a first upper hub, a first lower hub, a plurality of ribs connected in a hinged manner to the first upper hub and cooperating with the tent canvas, a plurality of counter-ribs, each counter-rib of the first umbrella structure having a first end part connected in a hinged manner to one of the ribs of said first umbrella structure and a second end part connected in a hinged manner to the first lower hub, the ribs and counter-ribs of the first umbrella structure being arranged such that the first lower hub is movable relative to the first upper hub along a first direction of movement, said first umbrella structure being able to assume an open position and a closed position;

a second mastless umbrella structure including a second upper hub, a second lower hub, a plurality of ribs connected in a hinged manner to the second upper hub and cooperating with the tent canvas, a plurality of counter-ribs, each counter-rib of the second umbrella structure having a first end part connected in a hinged manner to one of the ribs of said second umbrella structure and a second end part connected in a hinged manner to the second lower hub, the ribs and counter-ribs of the second umbrella structure being arranged such that the second lower hub is movable relative to the second upper hub along a second direction of movement, said second umbrella structure being able to assume an open position and a closed position; and at least a first junction configured to connect in a hinged manner the distal end of a first rib of the first umbrella structure and the distal end of a first rib of the second umbrella structure, the tent being able to assume a deployed position in which the first and second umbrella structures are in the open position and a folded position in which the first and second umbrella structures are in the closed position.

By distal end of a rib is meant the end of said rib opposite to the upper hub to which it is connected.

In an embodiment, the first and second umbrella structures are identical.

In an embodiment, the tent canvas includes an entrance door and ventilation openings. The tent canvas may be secured to the first umbrella structure and to the second umbrella structure. The tent canvas may be carried by the ribs of the first and second umbrella structures. The tent canvas can also be secured to the first upper hub, to the first lower hub and/or to the ribs of the first umbrella structure.

In the folded position, all the ribs and counter-ribs of the tent extend substantially parallel so that the tent forms a bundle. It can then be stored in a cylindrical-shaped storage bag.

In an embodiment, each counter-rib is connected to a corresponding rib by means of a joint, allowing said counter-rib to pivot relative to said rib.

In a non-limiting manner, the first junction connecting the distal ends of the first ribs of the first and second umbrella structures may consist of a pivot connection, such as a hinge, or of a ball-joint connection. It allows the pivoting of the first ribs and therefore of the first and second umbrella structures relative to each other. The first junction also connects the first and second umbrella structures when the tent is in the folded position. This avoids losing one of the umbrella structures.

The deployment of the tent is made by successively opening the two umbrella structures. Alternatively, the two umbrella structures can be opened simultaneously.

In order to place the first umbrella structure in the open position, the user displaces the first lower hub towards the first upper hub. This movement can be performed by pushing the first lower hub towards the first upper hub from the inside of the foldable tent. This movement can also be performed by pulling the first lower hub towards the first upper hub from the outside of the foldable tent.

This movement of approaching the first lower hub to the first upper hub has the effect of pivoting the ribs of the first umbrella structure relative to the first upper hub, causing their distancing from the first direction of movement.

In an embodiment, the passage of the first lower hub beyond a plane perpendicular to the first direction of movement and containing the joints between the ribs and the counter-rib of the first umbrella structure causes the locking of the first umbrella structure in the open position. The passage of this plane is also called hard point passage. It is accompanied by an inversion of the angle of inclination between the first lower hub and the counter-ribs of the first umbrella structure, and by a tensioning of said counter-ribs. When the first lower hub is between this plane and the first upper hub, the counter-ribs expand and push the first lower hub which then moves automatically towards the first upper hub.

In an embodiment, in the open position, the first lower hub is pressed against the first upper hub. The open position of the first umbrella structure is therefore a stable position.

The operating mode allowing to place the second umbrella structure in the open position is similar to that allowing to place the first umbrella structure in the open position. The umbrella structures allow deploying each of the ribs simultaneously and can therefore be opened quickly and without effort.

When deploying the foldable tent, the first junction allows in particular pivoting said umbrella structures and therefore positioning them relative to each other. When one of the two umbrella structures is placed in the open position, the first junction guides the movement of the other umbrella structure. It further allows a clearance between said first ribs facilitating the positioning of the two umbrella structures relative to each other and limiting the forces likely to damage the roof of the foldable tent when the latter is deployed.

Particularly, the successive open positioning of the two umbrella structures allows automatically forming the roof of the tent and thus defining an interior volume. Thanks to the disclosure, the foldable tent can therefore be deployed very quickly, by movement of the first and second lower hubs, with a minimum of effort.

The two umbrella structures form the framework of the tent. In an embodiment, the first junction forms a top of the foldable tent on which the tent canvas rests. Viewed vertically, the first and second upper and lower hubs extend below the first junction and therefore from the top of the foldable tent.

Considered from the inside of the tent, the umbrella structures have a concave profile, increasing the interior volume of the tent as a result of which the comfort of the user is improved.

In an embodiment, the tent canvas exerts a tension on the first and second umbrella structures allowing to hold them fixed relative to each other when the foldable tent rests on the ground.

The foldable tent may comprise at least three ribs. In an embodiment, the foldable tent comprises four ribs, the distal ends of which are configured to rest on the ground when the tent is deployed, so that said tent is sufficiently stable.

In an embodiment, the foldable tent further comprises an inner chamber disposed under the tent canvas and mounted on the first and second umbrella structures. The inner chamber is configured to accommodate the user.

In order to fold the tent, it is necessary to bring successively the two umbrella structures into the closed position. Alternatively, the two umbrella structures can be brought into the closed position simultaneously.

In order to bring the first umbrella structure into its folded position, the user must move the first lower hub apart from the first upper hub, for example by pulling on the first lower hub from the inside of the tent or by pushing the first lower hub from the outside of the tent, so that the first lower hub passes again the aforementioned plane and therefore the hard point.

The operating mode allowing to place the second umbrella structure in the open position is similar to that allowing to place the first umbrella structure in the closed position.

When the foldable tent is placed in the folded position, the two umbrella structures rest on the ground. The user can then gather them so as to form a bundle and place them in a storage bag. The ribs can be kept grouped by means of a strap.

The second direction of movement may be inclined with respect to the first direction of movement when the foldable tent is placed in the deployed position. In an embodiment, the angle between the first direction of movement and the second direction of movement is comprised between 70° and 100° and more preferably approximately equal to 90°.

Said directions of movement may be inclined with respect to the ground, when the foldable tent rests on the ground. In addition, the plane passing through the joints between the ribs and the counter-ribs of the first umbrella structure is also inclined with respect to the ground. Also, the roof of the tent forms a dome allowing to accommodate the user.

In an embodiment, the placing of one of the two umbrella structures in the open position causes the pivoting of the other umbrella structure with respect to the ground and consequently guides automatically the inclination of this other umbrella structure with respect to the ground. In an embodiment, each of the umbrella structures forms a support allowing to maintain the other umbrella structure inclined with respect to the ground.

In the deployed position, the directions of movement are oriented towards the torso of the user standing near the convex side of the umbrella structures. In addition, the first and second upper and lower hubs extend at the waist of this user. Said hubs are therefore particularly accessible, which facilitates the placing of the first and second umbrella structures in the open and closed positions. This facilitates the deployment of the tent and reduces fatigue and the physical trauma possibly associated.

In the folded position of the foldable tent, the first and second directions of movement may extend in a substantially parallel manner.

In an embodiment, the first and second umbrella structures extend on either side of a vertical plane passing through the first junction, when the foldable tent is placed in the deployed position and rests on the ground. Said vertical plane forms a plane of symmetry for the roof of the foldable tent. This conformation improves the stability of the tent on the ground.

In an embodiment, the first junction comprises a first sheath configured to receive the distal ends of the first ribs of the first and second umbrella structures. An interest is to connect and guide said first ribs while providing these first ribs with sufficient freedom to pivot and position themselves relative to each other upon deployment of the tent. The efforts to be exerted for deploying the tent are therefore reduced. In an embodiment, the first sheath forms a ball-joint connection between said first ribs.

In an embodiment, said first sheath is fastened, for example sewn, to the tent canvas, so that the first ribs cooperate with the tent canvas so as to carry it and stretch it when the foldable tent is deployed.

In a non-limiting manner, said first sheath may comprise a first sheath portion configured to receive the distal end of the first rib of the first umbrella structure and a second sheath portion configured to receive the distal end of the first rib of the first second umbrella structure.

According to a particularly advantageous aspect of the disclosure, the first rib of the first umbrella structure comprises a first rib portion, a second rib portion and a hinge connecting said first and second rib portions pivotally about an axis transverse to said first and second rib portions, said first umbrella structure being configured to bring the second rib portion into an unfolded position, when the first umbrella structure is brought into the open position, and to bring the second rib portion into a folded down position, when the first umbrella structure is brought into the folded position.

The counter-rib associated with the first rib cooperates with the first rib portion of said first rib.

In the open position of the first umbrella structure, the first and second rib portions may be aligned and extend in continuity with each other. In the folded down position, the first and second rib portions may form an angle relative to each other. The hinge forms a pivot connection between the first and second rib portions.

The second rib portion has the advantage of increasing the interior volume of the foldable tent when the latter is placed in the deployed position, as a result of which the comfort of the user is improved. This second rib portion able be folded down further allows increasing the compactness of the foldable tent once folded. Indeed, in the folded down position, the second rib portion extends substantially parallel to the first rib portion. The first and second rib portions then extend next to each other, which allows storing them in a reduced-size storage bag.

The opening of the first umbrella structure allows bringing automatically the second rib portion into the unfolded position. Similarly, the closing of the first umbrella structure allows bringing automatically the second rib portion into the folded down position. The user is not required to unfold the second rib portion manually. It is therefore understood that the deployment of the tent is still facilitated.

In an embodiment, several ribs of the foldable tent comprise such first and second rib portions. In another embodiment, each of the umbrella structures comprises four ribs having such first and second rib portions. This further increases the volume of the deployed tent and the compactness of the folded tent. In this advantageous variant, each of the second rib portions is unfolded simultaneously during the opening of the umbrella structure.

In an embodiment, the first upper hub may comprise an attachment portion, such as a hook, and the distal end of the first rib of the first umbrella structure may be provided with a fastening element, such as an elastic, configured to cooperate with the attachment portion so as to releasably hold said second portion of the first rib in the folded down position.

In an embodiment, said hinge is configured to limit the pivoting of the second rib portion relative to the first rib portion when said second rib portion is unfolded. It is understood that the pivoting of the second rib portion is interrupted when the first and second rib portions extend in the extension of one another. The tension exerted by the tent canvas on the first rib allows holding the second rib portion in the unfolded position.

The angular displacement of the second rib portion between the folded down position and the unfolded position may be comprised between 170° and 190°. In an embodiment, the angular displacement is equal to approximately 180°. In the unfolded position, the second rib portion extends in continuity of the first rib portion.

In an embodiment, the foldable tent has an interior volume defined by the first and second umbrella structures, when placed in the deployed position, and said hinge is configured to move towards the interior volume when the first umbrella structure is brought from its open position towards its closed position. In other words, the second rib portion pivots outwardly of the interior volume when the first umbrella structure is closed.

In an embodiment, the movement of the hinge is performed by the influence of gravity, under its own weight. This movement tends to bring the distal end of the first rib and the first upper hub closer to each other. This allows the user to easily gather the first and second rib portions in order to form a bundle, and therefore facilitates the storage of the foldable tent.

In an embodiment, the tent canvas is connected to said hinge. An interest is to guide the tent canvas between the first and second rib portions when the first umbrella structure is brought into the folded position, and thus contain it substantially in the first closed umbrella structure. The compactness of the folded tent is improved.

In an embodiment, the roof comprises at least a second junction configured to connect in a hinged manner the distal end of a second rib of the first umbrella structure and the distal end of a second rib of the second umbrella structure.

The second junction may be identical to the first junction. In an embodiment, the tent has a longitudinal vertical plane of symmetry, the first and second junctions extending on either side of said longitudinal vertical plane of symmetry. The first and second junctions may extend at the same height and form together an upper part of the tent.

The second junction may comprise a second sheath.

In an embodiment, the first and second umbrella structures each include third and fourth ribs each having a distal end configured to rest on the ground when the foldable tent is placed in the deployed position. An interest is to ensure the stability of the tent, even on a rough terrain. The first and second ribs consequently allow the connection between the umbrella structures, while the third and fourth ones ensure the stability of the foldable tent.

The distance between the distal ends of the first and second ribs of an open umbrella structure may be less than or equal to the distance between the distal ends of the third and fourth ribs of said umbrella structure.

Alternatively, each of the umbrella structures may include only one rib whose distal end is configured to rest on the ground when the foldable tent is deployed. Also, in this variant, only two ribs of the foldable tent are in contact with the ground. The foldable tent may then include a plurality of stabilizing members configured to improve the stability of the tent, for example guy ropes. These guy ropes may include a first end cooperating with the roof of the foldable tent and a second end, opposite the first end, configured to be anchored to the ground.

In an embodiment, the first umbrella structure comprises a fifth rib having a distal end cooperating with a cooperation portion of the tent canvas, the fifth rib having a length smaller than the length of the third and fourth ribs of the first umbrella structure and extending between said third and fourth ribs.

Said fifth rib allows moving apart the tent canvas outwardly of the foldable tent, so as to increase the interior volume defined by said tent canvas. This allows improving the comfort of the user.

The tent canvas cooperates with the distal end of the fifth rib. Tension lines are formed on the tent canvas between the distal ends of the third, fourth and fifth ribs. This allows stretching a portion of triangular tent canvas forming a vertical panel extending between the third and fourth ribs. The tent canvas is therefore not inclined at this location, which allows preventing the head or the feet of the user lying in the foldable tent from touching the tent canvas. The comfort of the user is therefore improved.

In an embodiment, the ribs of the first umbrella structure each have a distal end, the tent canvas cooperating with said distal ends. Said distal ends may be secured to the tent canvas. Tension lines are formed on the tent canvas between the distal ends of the ribs of the first umbrella structure. An interest is to stretch the tent canvas in order to prevent it from moving in case of wind. This in particular reduces noise pollution for the user of the tent. In addition, the tent canvas allows tensioning said ribs to give them a convex shape.

In an embodiment, the tent canvas also cooperates with the distal ends of the ribs of the second umbrella structure.

In an embodiment, the tent canvas is also connected to the first upper hub. Also, a tension line is formed on the tent canvas between the distal end of the ribs of the first umbrella structure and the first upper hub.

In the embodiment where one or more ribs of the first umbrella structure comprise first and second rib portions hinged together, this tension allows automatically bringing said second rib portions into the unfolded position, upon opening of the first umbrella structure. The same applies for the second umbrella structure.

In an embodiment, the tent canvas has a peripheral edge, and said peripheral edge is connected to the distal ends of said third and fourth ribs of the first umbrella structure. The peripheral edge therefore extends partially close to the ground and the tent canvas almost completely covers the first and second umbrella structures.

When the first umbrella structure comprises a fifth rib, the peripheral edge of the tent canvas can be connected to said fifth rib so as to move the peripheral edge away from the ground and thus form a ventilation. Alternatively, the cooperation portion of the fifth rib with the tent canvas can be distinct from the peripheral edge.

In an embodiment, the first upper hub has a through orifice, the first umbrella structure further includes an actuating element fastened to the first lower hub and passing through the orifice, whereby the first umbrella structure is brought into the open position by exerting traction on the actuating element from the outside of the foldable tent, so as to bring the first lower hub closer to the first upper hub in order to cause the deployment of the ribs.

In an embodiment, the actuating element is a cord fastened to the first lower hub. In order to bring the foldable tent into the deployed position, the user pulls on the cord which causes the deployment of the ribs.

In an embodiment, the first lower hub has a diameter smaller than the diameter of the first upper hub. An interest is to facilitate moving the ribs of the first umbrella structure apart from each other and therefore moving the first lower hub relative to the first upper hub.

In an embodiment, the first rib of the second umbrella structure comprises a first rib portion, a second rib portion and a hinge pivotally connecting said first and second rib portions, the roof of the foldable tent being shaped such that a tension line is formed on the tent canvas between the distal end of the third rib of the first umbrella structure and said hinge, when the first umbrella structure is open. An interest is to maintain the distal end of the first rib of the first umbrella structure above the ground when only this one is open. In other words, this tension line allows maintaining the first umbrella structure inclined with respect to the ground when only this one is open.

With this inclination, the second umbrella structure easily pushes, upwards, on the first umbrella structure upon its opening and causes the pivoting of the first umbrella structure with respect to the ground, towards its final inclination.

SHORT DESCRIPTION OF THE DRAWINGS

The disclosure will be better understood upon reading the following description of one embodiment of the disclosure given by way of non-limiting example, with reference to the appended drawings, wherein.

DETAILED DESCRIPTION

The disclosure relates to a foldable tent comprising two umbrella structures and able to assume a folded position corresponding to a storage position, and a deployed position corresponding to a use position.

Figure 1:
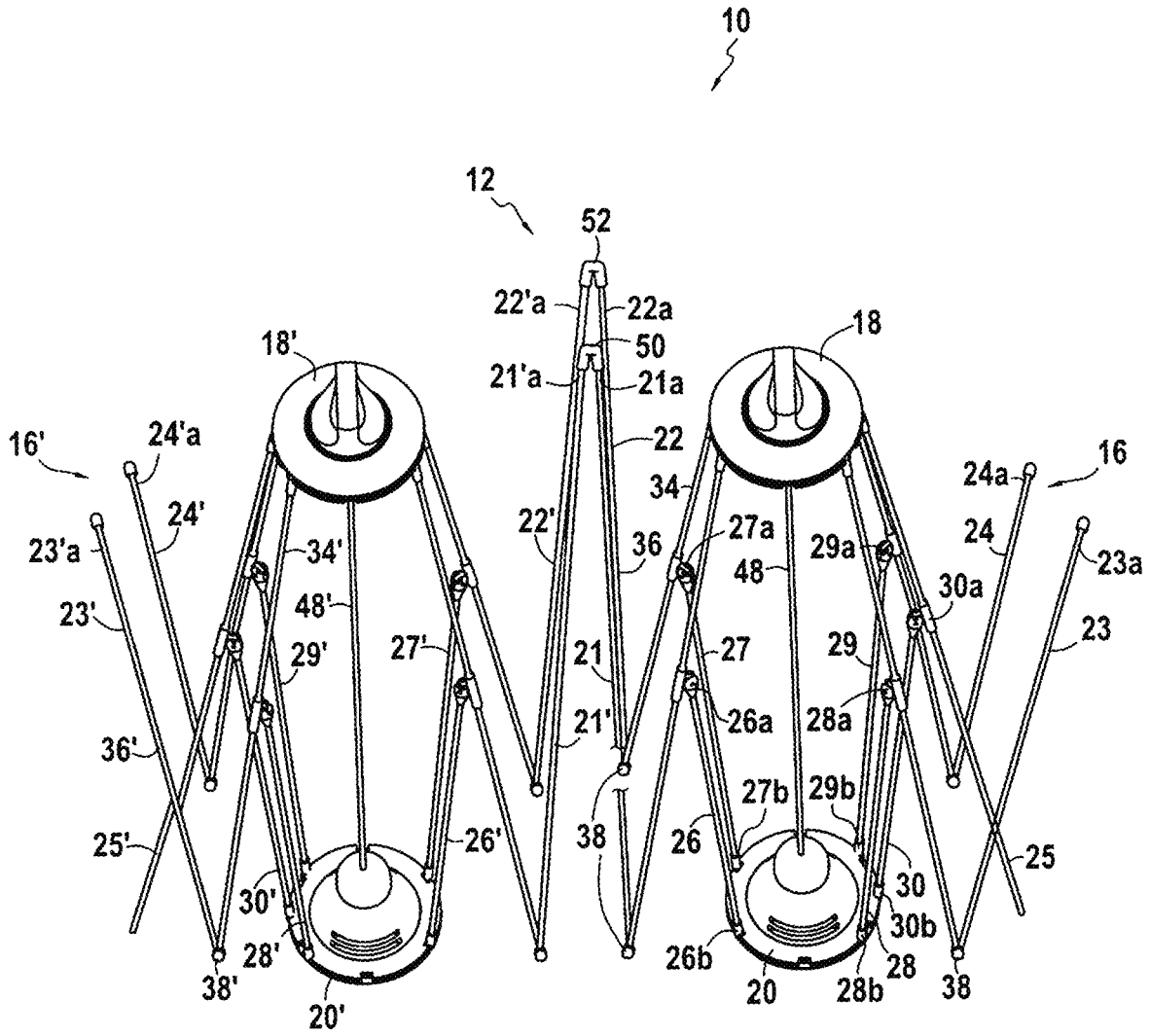
FIG. 1 illustrates a foldable tent according to the disclosure, in the folded position.

FIG. 1 illustrates a foldable tent 10 according to the present disclosure, placed in the folded position.

The foldable tent 10 comprises a roof 12 which consists of a tent canvas 14, of a first umbrella structure 16 and of a second umbrella structure 16'. For reasons of readability, the tent canvas 14 is not represented in FIG. 1 but is visible in FIG. 8.

As can be seen in this FIG. 1, the first umbrella structure 16 comprises a first upper hub 18, a first lower hub 20 and a plurality of ribs connected in a hinged manner to the first upper hub 18. More specifically, the first umbrella structure 16 comprises first 21, second 22, third 23, fourth 24 and fifth 25 ribs. In this non-limiting example, these ribs are pivotally mounted relative to the first upper hub 18.

The first umbrella structure 16 further comprises first 26, second 27, third 28, fourth 29 and fifth 30 counter-ribs. Each of these counter-ribs comprises a first end part 26*a*, 27*a*, 28*a*, 29*a*, 30*a* and a second end part 26*b*, 27*b*, 28*b*, 29*b*, 30*b*, opposite to the first end part. The first end parts of the first 26, second 27, third 28, fort 29 and fifth 30 counter-ribs are connected in a hinged manner respectively to the first 21, second 22, third 23, fourth 24 and fifth 25 ribs by means of joints 32. The second end parts of the first, second, third, fourth and fifth counter-ribs are connected in a hinged manner to the first lower hub 20. In this non-limiting example, the counter-ribs 26, 27, 28, 29, 30 are pivotally connected to the first lower hub 20 and to the ribs.

Figure 2:
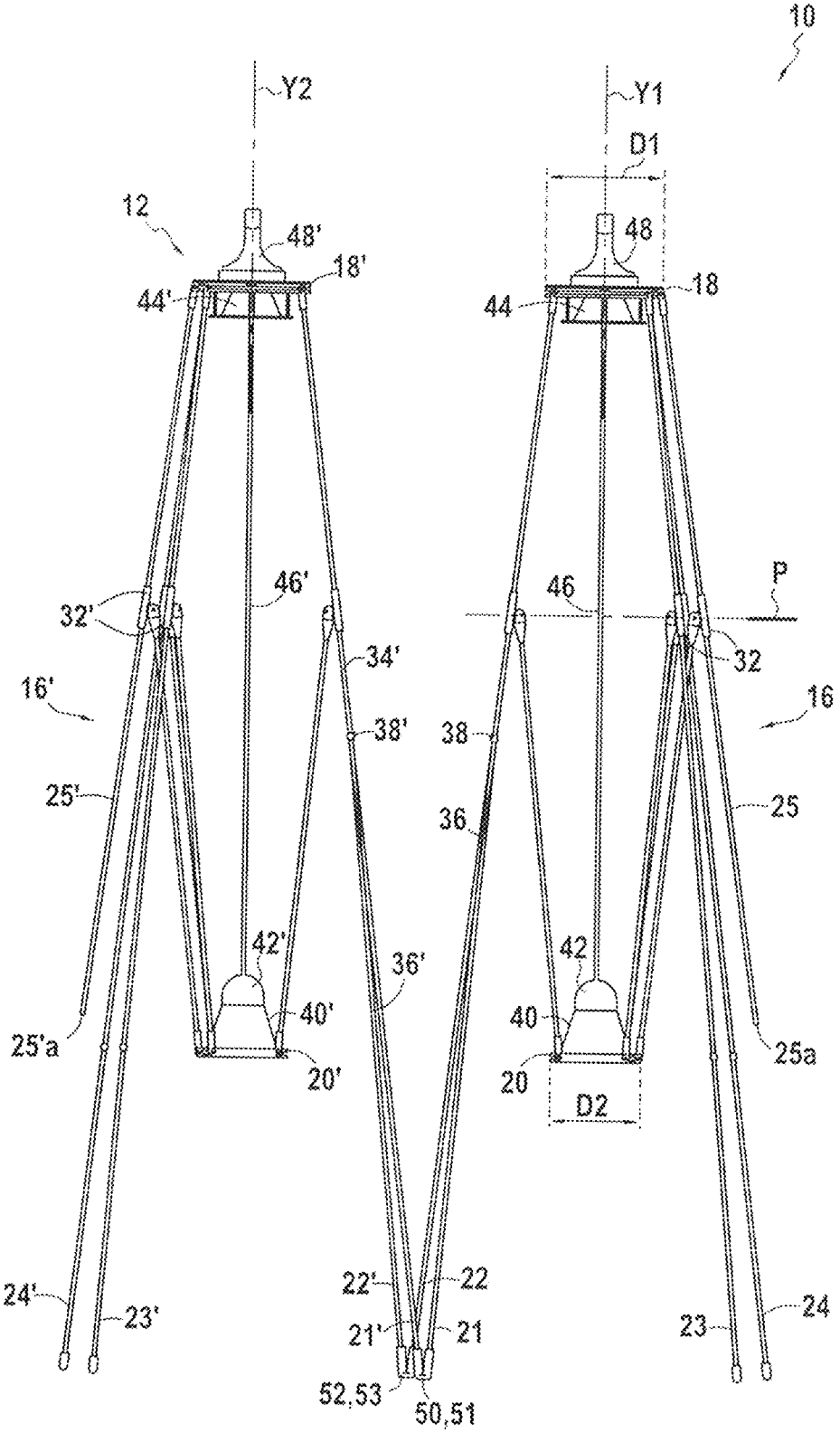
FIG. 2 illustrates the foldable tent of FIG. 1, in side view, the second rib portions being unfolded.

As illustrated in FIG. 2, the ribs and counter-ribs of the first umbrella structure are arranged so that the first lower hub 20 is movable in translation relative to the first upper hub 18 in a first direction of movement Y1. The first umbrella structure 16 forms a mastless umbrella structure.

The first 21, second 22, third 23 and fourth 24 ribs of the first umbrella structure 16 each include a first rib portion 34, a second rib portion 36 and a hinge 38 pivotally connecting said first and second rib portions. The hinges 38 are configured so that the second rib portions 36 pivot relative to the first rib portions 34 along axes transverse to said first and second rib portions. The second rib portions 36 can assume an unfolded position in which they extend in continuity with the first rib portions 34, as illustrated in FIG. 2. The second rib portions 36 can also assume a folded down position in which they form an angle with the first rib portions 34, as illustrated in FIG. 1.

Said hinges 38 are configured to limit the pivoting of the second rib portions 36 relative to the first rib portions 34, when said second rib portions are brought into the unfolded position. The angular displacement of the second rib portions 36 is of about 180° between the folded down position and the unfolded position.

In the folded position of the foldable tent 10, illustrated in FIG. 1, said second rib portions 36 are in the folded down position.

The fifth rib 25 of the first umbrella structure comprises a first rib portion 34 but no second rib portion. Also, the fifth rib 25 has a length smaller than that of the other ribs 21, 22, 23, 24. The fifth rib 25 extends between the third and fourth ribs 23, 24 of the first umbrella structure 16.

In FIG. 2, it will be noted that the first upper hub 18 has a diameter D1 greater than the diameter D2 of the first lower hub 20 and that the first upper 18 and lower 20 hubs are coaxial.

In FIG. 2, in which the second rib portions 36 have been unfolded, it can be seen that the first lower hub 20 has an elongated portion 40. The first lower hub 20 further includes an end forming a bearing portion 42 disposed at the top of the elongate portion 40. The first upper hub 18 also includes a through orifice 44 which opens axially on either side of the first upper hub 18.

In order to allow its opening, the first umbrella structure 16 further includes a cord 46, forming an actuating element, which is fastened to the first lower hub 20 and which passes through the through orifice 44. The cord 46 is fastened to the bearing portion 42 of the first lower hub 20, passes through the first upper hub 44, and has an end provided with a first gripping ring 48.

The first umbrella structure 16 can be placed in an open position and in a closed position. In the folded position of the tent, illustrated in FIG. 1, the first umbrella structure 16 is placed in the closed position.

The second umbrella structure 16' is identical to the first umbrella structure 16 so that it comprises a second lower hub 20', a second upper hub 18', and a plurality of ribs and counter-ribs. More precisely, the second umbrella structure 16' comprises first 21', second 22', third 23', fourth 24' and fifth 25' ribs and first 26', second 27', third 28', fourth 29' and fifth 30' counter-ribs. The counter-ribs are connected to the second lower hub 20' and to the ribs by means of joints 32'. The second lower hub 20' is movable in translation relative to the second upper hub 18' along a second direction of movement Y2. The first, second, third and fourth ribs of the second umbrella structure 16' each comprise a first rib portion 34' and a second rib portion 36' connected in a hinged manner by means of a hinge 38'. The second lower hub comprises a bearing portion 42'. The second umbrella structure 16' further comprises a second cord 46' provided with a second gripping ring 48' and connected to the second lower hub 20'. The second umbrella structure 16' can also be opened or closed.

In FIG. 1, it can be seen that the foldable tent 10 is in the folded position and the first and second umbrella structures 16, 16' are in the closed position. The second rib portions 36, 36' of the two umbrella structures 16, 16' are in the folded down position so that the set of the first 34, 34' and second 36, 36' rib portions extend substantially together and parallel to the first and second directions of movement Y1, Y2.

The first rib 21 of the first umbrella structure 16 has a distal end 21*a* opposite to the first upper hub 18. Similarly, the first rib 21' of the second umbrella structure 16' has a distal end 21'*a* opposite to the second upper hub 18'. Said distal ends 21*a*, 21'*a* of the first ribs 21, 21' of the first 16 and second 16' umbrella structures are engaged in a first sheath 50 sewn to the tent canvas 14. This first sheath 50 allows connecting and hinging said first ribs 21, 21' together, allowing in particular these first ribs to pivot relative to each other. Also, the first sheath 50 forms a first junction 51. In addition, thanks to this first sheath 50, said first ribs 21, 21' carry the tent canvas 14.

Similarly, the second ribs 22, 22' of the first and second umbrella structures 16, 16' each have a distal end 22*a*, 22'*a*. These distal ends 22*a*, 22'*a* are engaged in a second sheath 52. The second ribs can therefore pivot relative to each other and also carry the tent canvas 14 so that they cooperate with the tent canvas. The second sheath 52 forms a second junction 53.

The tent canvas 14 is connected to the first and second umbrella structures 16, 16' at the first and second upper hubs 18, 18', the joints 32, 32' and the distal ends of the first 21, 21', second 22, 22', third 23, 23' and fourth 24, 24' ribs of each of the two umbrella structures 16, 16'.

Figure 3:
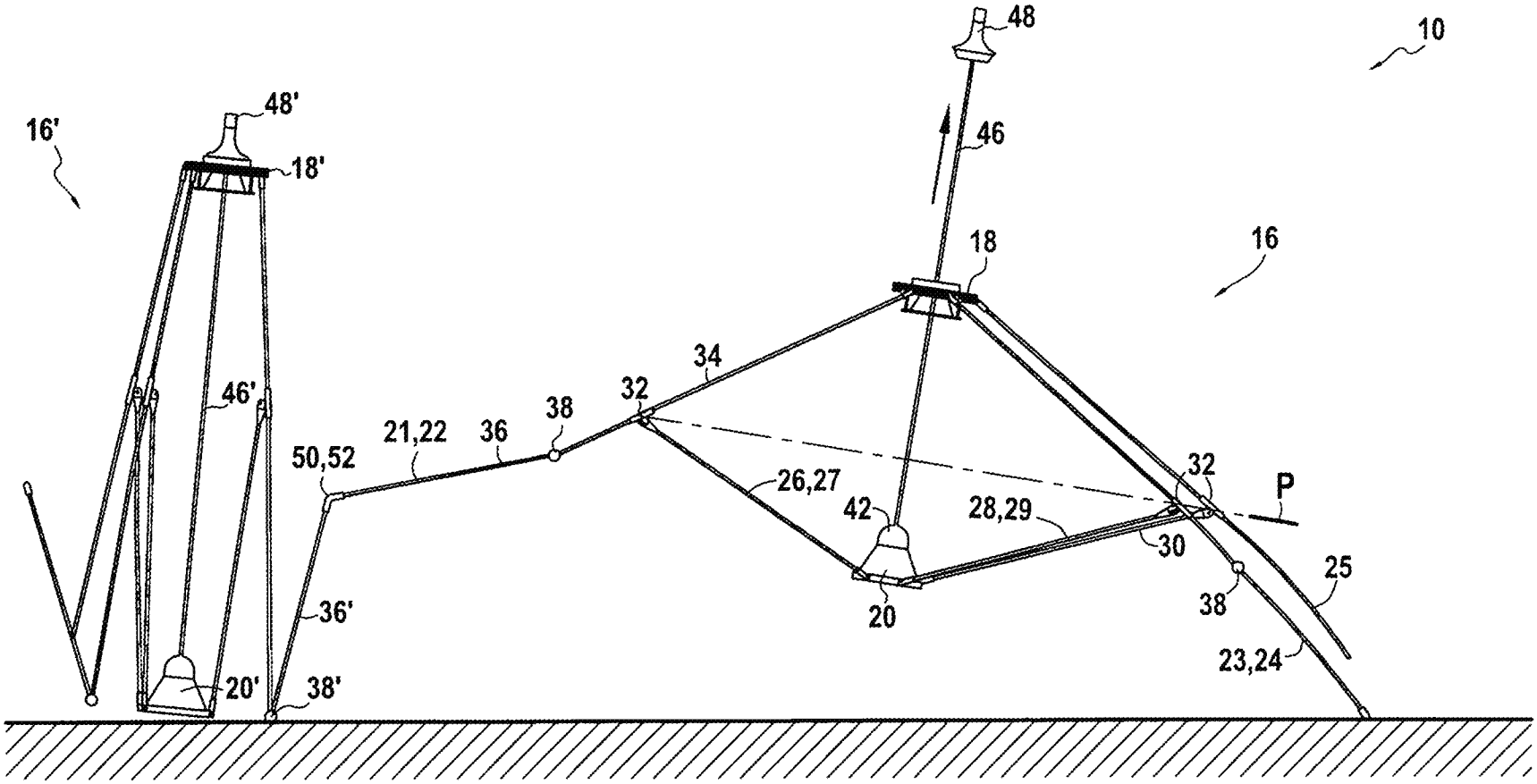
FIG. 3 illustrates the foldable tent of FIG. 2, wherein the first umbrella structure is in an intermediate position.
Figure 4:
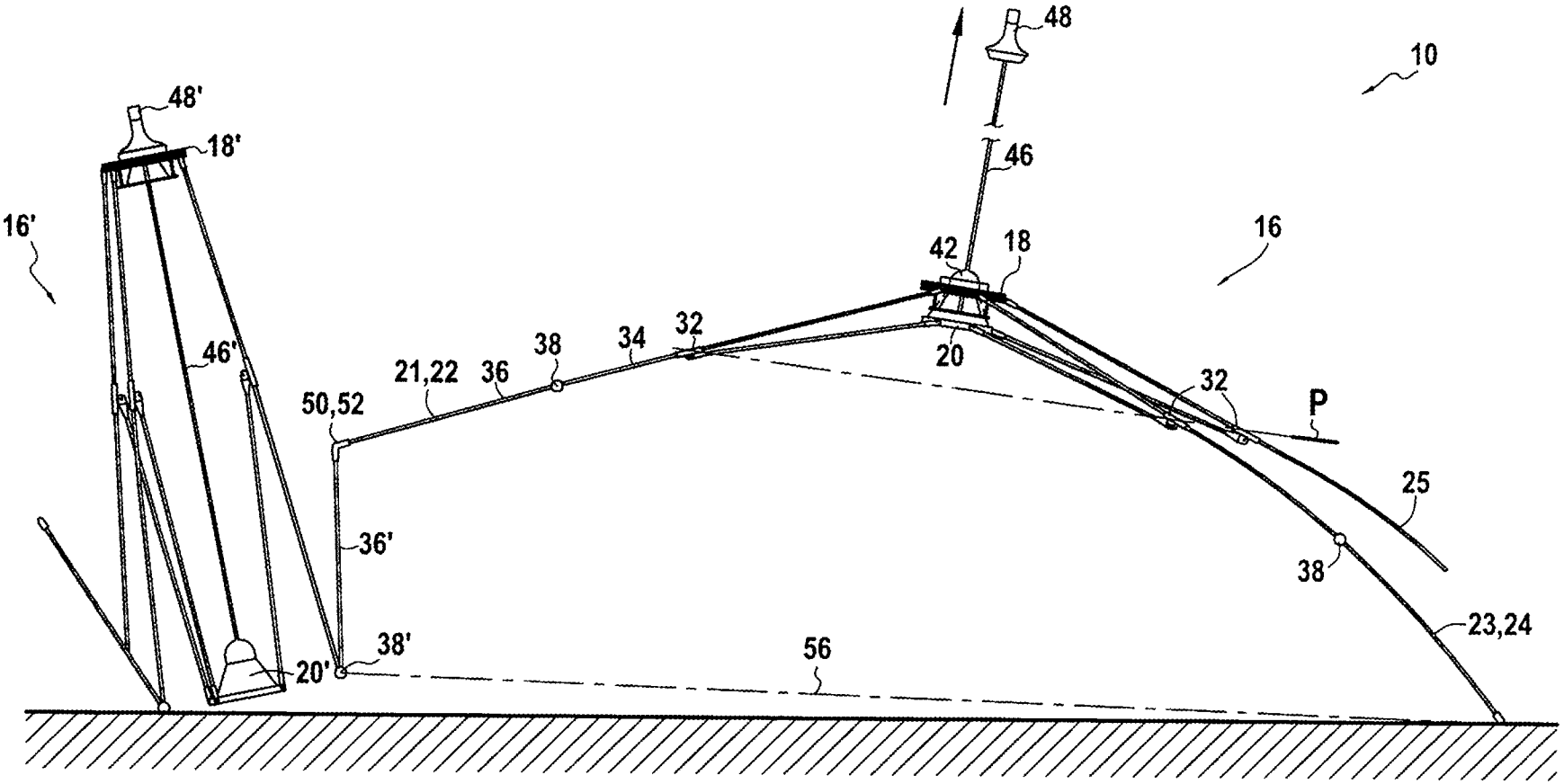
FIG. 4 illustrates the foldable tent of FIG. 3, wherein the first umbrella structure is in the open position.
Figure 5:
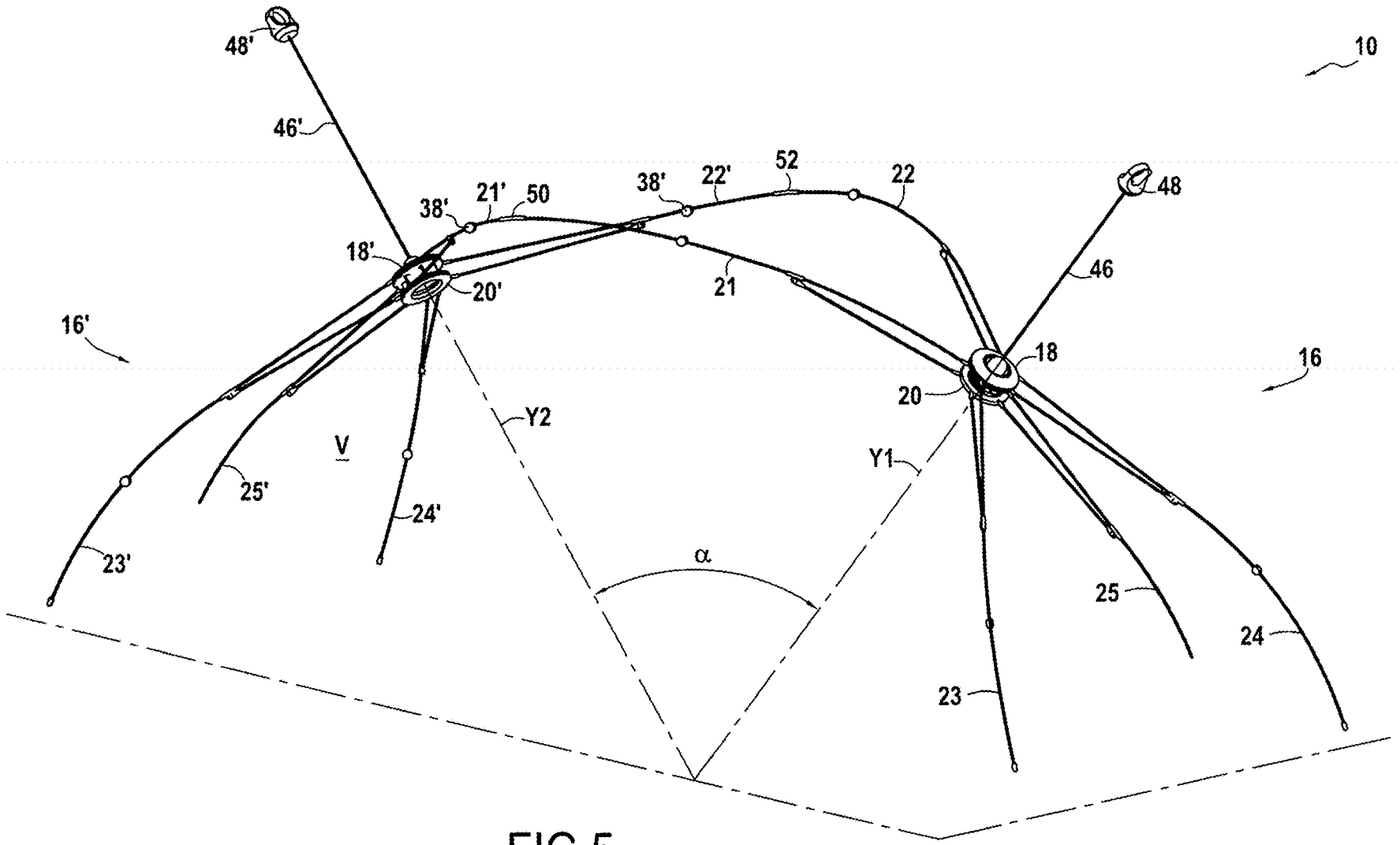
FIG. 5 illustrates the foldable tent of FIG. 4 in the deployed position.

FIGS. 3 to 5 illustrate the placing of the foldable tent 10 in the deployed position. To do this, the first and second umbrella structures 16, 16' are brought successively from their closed position to their open position.

In this non-limiting example, the first umbrella structure 16 is first brought into the open position and the second umbrella structure 16' after that. First, the user stands next to the foldable tent 10 placed in the folded position and pulls the first cord 46 towards him, using the first gripping ring 48. This traction allows moving the first lower hub 20 along the first direction of movement Y1 and bringing it closer to the first upper hub 18, as illustrated in FIG. 3.

The counter-ribs 26, 27, 28, 29, 30 of the first umbrella structure 16 guide the movement of the first lower hub 20. Parallel to the movement of the first lower hub 20, the counter-ribs exert a force on the first rib portions 34 of the ribs 21, 22, 23, 24, 25 of the first umbrella structure 16, tending to move them apart from each other. Said first rib portions 34, as well as the hinges 38 connecting them to the second rib portions 36, move apart from each other and pivot outwardly of the first umbrella structure 16.

Insofar as the diameter D1 of the first upper hub 18 is greater than the diameter D2 of the first lower umbrella 20, moving the ribs apart from each other and moving the first lower hub towards the first upper hub is facilitated.

As illustrated by the passage of FIG. 3 to FIG. 4, the counter-ribs jointly cross together a plane P passing through the joints 32 between the ribs and the counter-ribs and which is perpendicular to the first direction of movement Y1. The crossing of this plane P by the counter-ribs is also called the crossing of the hard point. The first lower hub 20 is brought into contact with the first upper hub 18 in a stable position, insofar as the first lower hub 20 cannot cross the plane P without effort operated by the user. The elongate portion 40 of the first lower hub 20 passes through the orifice 44 of the first upper hub 18 and the bearing portion 42 of the first lower hub 20 protrudes out of the foldable tent 10.

Insofar as the tent canvas 14 is connected to the first upper hub 18, to each of the hinges 38 and to the distal ends of the first 21, second 22, third 23 and fourth 24 ribs, the tent canvas is tensioned during the opening of the first umbrella structure 16. In addition, the tent canvas exerts a tension on said ribs between the first upper hub 18 and said distal ends of each of the ribs.

As a result, the second rib portions 36 are automatically pivoted towards their unfolded positions. The hinges 38 limit this pivoting when the second rib portions 36 are positioned in continuity of the first rib portions 34, as illustrated by the passage from FIG. 3 to FIG. 4. In addition, the tent canvas 14 exerts a force on the second rib portions 36 preventing them from folding down inadvertently. The second rib portions 36 are therefore brought into the unfolded position automatically during the opening of the first umbrella structure 16 and held in this unfolded position by the tension exerted by the tent canvas 14 on the ribs.

In addition, the tensioning of the tent canvas 14 allows keeping the ribs of the first umbrella structure 16 curved. The first umbrella structure 16 deployed has therefore a convex shape considered from the inside of the foldable tent 10.

The first umbrella structure 16 is then placed in the open position in which its ribs are completely moved apart from each other. Therefore, the foldable tent 10 is placed in an intermediate position illustrated in FIG. 4, wherein the first umbrella structure 16 is open while the second umbrella structure 16' is always closed.

The operator can then open the second umbrella structure 16'. To do so, it is appropriate to stand on the other side of the foldable tent 10, facing the second upper hub 18' and to pull the second cord 46' of the second umbrella structure.

The opening of the second umbrella structure 16' is similar to the opening of the first umbrella structure 16. Particularly, the first and second sheaths 50, 52 connecting in a hinged manner the first 21, 21' and second 22, 22' ribs allow the relative pivoting of the first 21 and second 22 ribs of the first umbrella structure 16 relative to the first 21' and second 22' ribs of the second umbrella structure 16'. This allows the positioning of the first and second umbrella structures relative to each other, in order to shape the foldable tent 10.

Furthermore, the tent canvas 14 is also connected to the second upper hub 18' as well as to the hinges 32' and to the distal ends of the ribs of the second umbrella structure 16'. In addition, the tent canvas 14 is shaped such that the tension lines 56 are formed on the tent canvas between the hinges 38' of the first and second ribs 21', 22' of the second umbrella structure 16' and respectively the distal ends 23*a*, 24*a* of the third 23 and fourth 24 ribs of the first umbrella structure 16. These tension lines allow, in this intermediate position of the foldable tent 10, maintaining the first umbrella structure and the plane P inclined with respect to the ground. Also, as illustrated in FIG. 4, the third and fourth ribs 23, 24 of the first umbrella structure rest on the ground while the first 21 and second 22 ribs of the first umbrella structure do not touch the ground.

By virtue of this configuration, when the second umbrella structure 16' is brought into the open position, as illustrated by the passage from FIG. 4 to FIG. 5, the first 21' and second 22' ribs of the second umbrella structure exert a pushing force oriented upwards on the first 21 and second 22 ribs of the first umbrella structure 16. This force tends to further pivot the first umbrella structure, in order to automatically bring it towards a final inclination allowing the automatic shaping of the foldable tent 10, as illustrated in FIG. 5. In addition, the first umbrella structure 16 supports the second umbrella structure 16' and vice versa. The foldable tent 10 is then deployed.

Without departing from the scope of the disclosure, the second umbrella structure 16' could be open before the first umbrella structure 16.

In the deployed position of the foldable tent 10, the tent canvas 14 defines an interior volume V. The plane P passing through the joints of the first umbrella structure is inclined with respect to the ground by an angle approximately equal to 45°. It is seen that the first and second directions of movement Y1, Y2 are inclined with respect to the ground by an angle approximately equal to 45°. They are further inclined with respect to each other by an angle $\alpha$ approximately equal to 90°. The foldable tent 10 then has a dome shape that can accommodate a camper.

The foldable tent further comprises an inner chamber (not represented) disposed under the tent canvas and mounted on the first and second umbrella structures 16, 16'. Said inner chamber is configured to accommodate the user.

Figure 6:
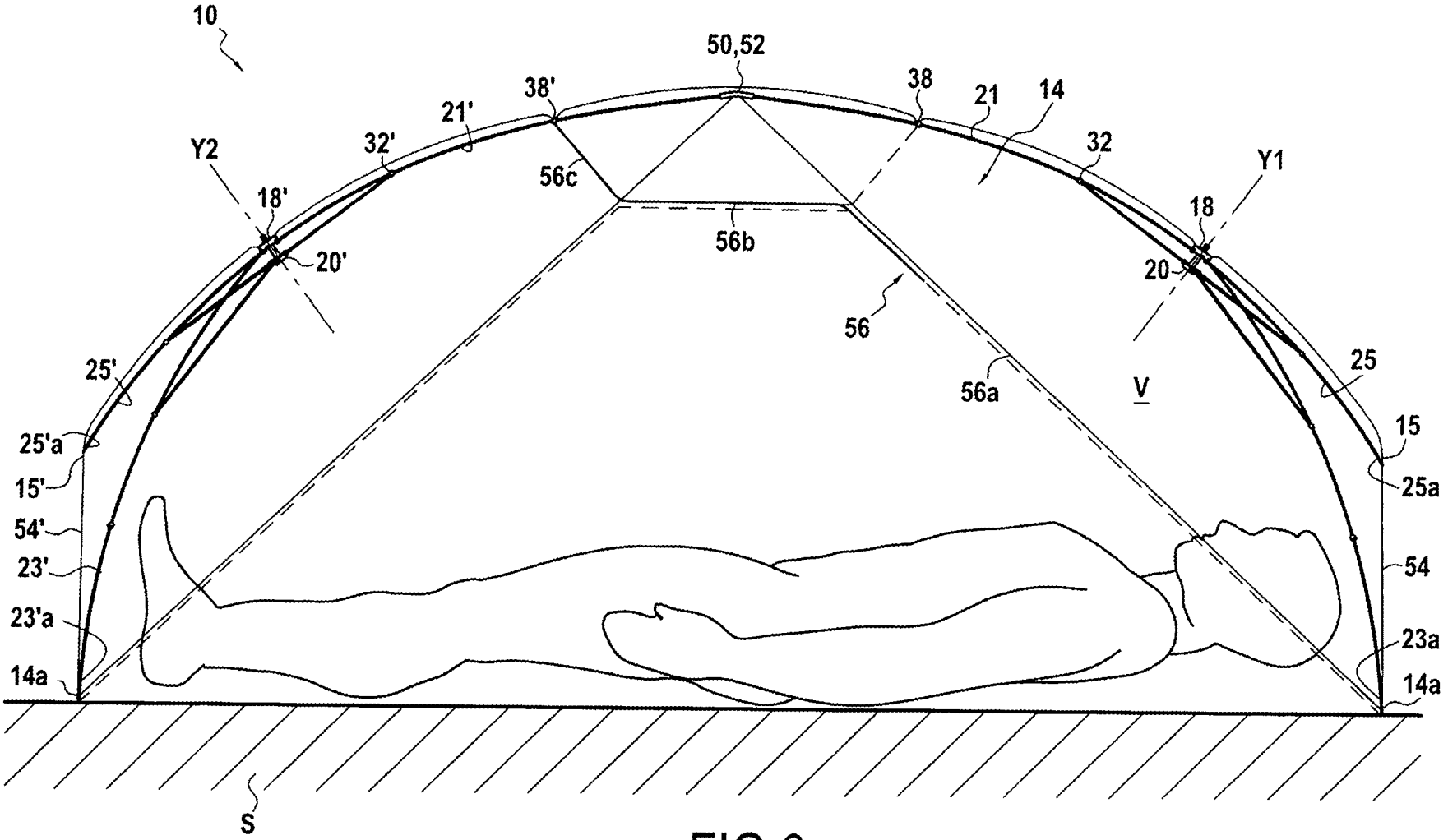
FIG. 6 illustrates the deployed foldable tent of FIG. 5 in side view.

FIG. 6 is a side view of the foldable tent 10 according to the disclosure, wherein the tent canvas 14 is visible. It can be seen that the tent canvas comprises a peripheral edge 14*a* operating with the distal ends 23*a*, 23'*a*, 24*a*, 24'*a* of the third 23, 23' and fourth 24, 24' ribs of the first and second umbrella structures 16, 16'. In addition, the distal ends 25*a*, 25'*a* of the fifth ribs 25, 25' of the first and second umbrella structures 16, 16' cooperate each with a cooperation portion 15, 15' of the tent canvas 14, distinct from said peripheral edge 14*a* of said tent canvas. Also, the fifth ribs move apart said tent canvas and increase the internal volume V. Vertical triangular panels 54, 54' are formed on the tent canvas 14. The fifth ribs 25, 25' prevent the tent canvas from coming into contact with the head or feet of a user lying in the tent and thus improve his comfort.

According to the disclosure, the foldable tent 10 can be placed in the deployed position very quickly, only by opening the first and second umbrella structures.

As can be seen in FIG. 6, the tension line 56 formed on the tent canvas 14 between the distal end 23*a* of the third rib 23 of the first umbrella structure 16 and the hinge 38' of the first rib 21' of the second umbrella structure 16' include distinct first, second and third segments 56*a*, 56*b*, 56*c*. These three segments are arranged so that an opening, for example for a door, can be formed in the tent canvas 14 without the tension line 56 intersecting said door. More specifically, the first segment 56*a* and the third segment 56*c* are substantially parallel while the second segment 56*b* extends substantially horizontally. Another tension line is also formed between the distal end 23*a'* of the third rib 23' of the second umbrella structure 16' and the hinge 38 of the first rib 21 of the first umbrella structure 16.

Figure 7:
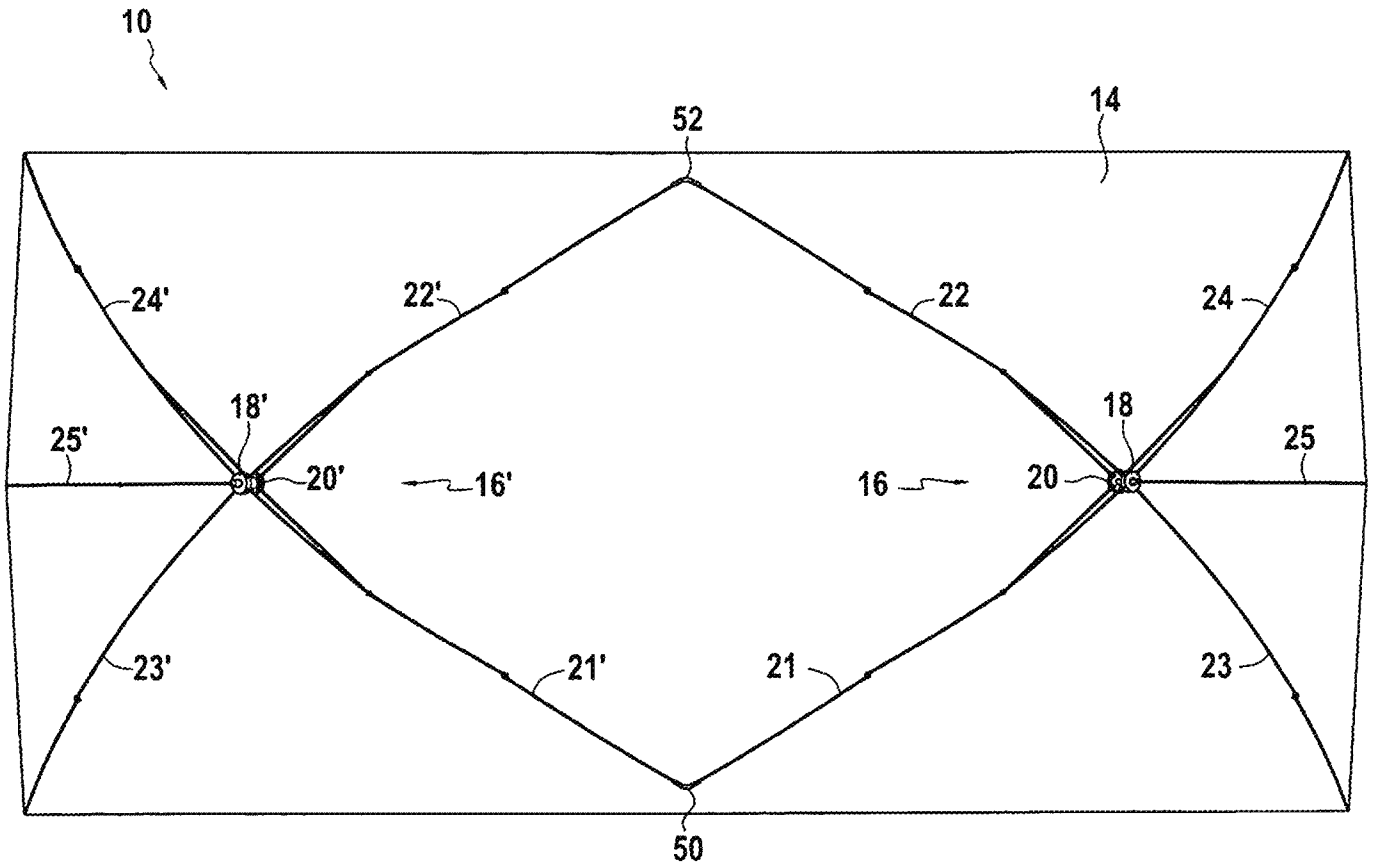
FIG. 7 illustrates the foldable tent of FIG. 6 in top view.

FIG. 7 is a top view of the foldable tent.

Figure 8:
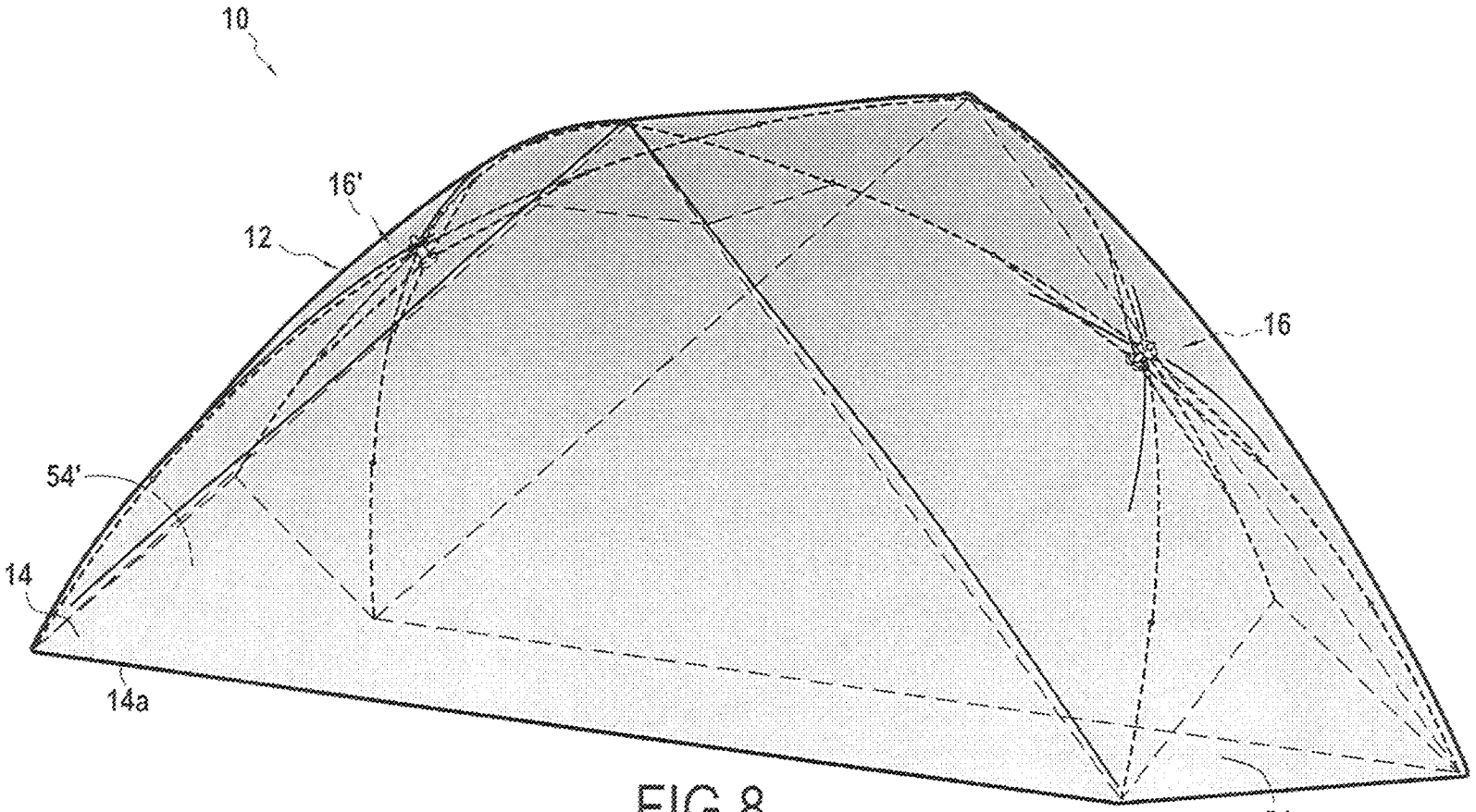
FIG. 8 illustrates the foldable tent of FIG. 5, in which the tent canvas is visible.

FIG. 8 illustrates the foldable tent 10 in the deployed position, the tent canvas 14 being visible. The third 23, 23' and fourth 24, 24' ribs of the first and second umbrella structures rest on the ground.

In order to fold the foldable tent 10, the user must successively place the first 16 and second 16' umbrella structures in the closed position. To do so, it is necessary to actuate the bearing portions 42, 42' of the first and second lower hubs 20, 20'. Said bearing portions 42, 42' pass through the tent canvas 14 so that they are accessible from the outside of the foldable tent 10.

When the user exerts a pressure on the bearing portion 42 of the first lower hub 20 from the outside of the foldable tent 10, this pressure is directed along the first direction of movement Y1. The first lower hub 20 is then moved apart from the first upper hub 18 and passes beyond the plane P. The ribs 21, 22, 23, 24, 25 of the first umbrella structure 16 are brought closer to each together. Under their own weight, and under the weight of the first umbrella structure, the hinges 38 of the ribs of said first umbrella structure are moved towards the interior volume V of the foldable tent, while the second rib portions 36 are pivoted outwardly of the foldable tent and towards the first upper hub 18. The second rib portions 36 are therefore automatically folded down upon closing of the first umbrella structure. The first umbrella structure 16 is brought into the closed position.

In parallel, the second umbrella structure 16' pivots so that the distal ends of its first 21' and second 22' ribs are brought closer to the ground.

The same operation is repeated for the second umbrella structure 16' which is also brought into the closed position. The foldable tent is then in the folded position, as illustrated in FIG. 1 and forms a bundle. The foldable tent can then be easily stored in a storage bag.

Without departing from the scope of the disclosure, the second umbrella structure 16' could be closed before the first umbrella structure 16.

The invention claimed is:

1. A foldable tent comprising a roof having:

a tent canvas;

a first mastless umbrella structure including a first upper hub, a first lower hub, a plurality of ribs connected in a hinged manner to the first upper hub and cooperating with the tent canvas, and a plurality of counter-ribs, each counter-rib of the first umbrella structure having a first end part connected in a hinged manner to one of the ribs of said first umbrella structure and a second end part connected in a hinged manner to the first lower hub, the ribs and counter-ribs of the first umbrella structure being arranged such that the first lower hub is movable relative to the first upper hub along a first direction of movement, said first umbrella structure being able to assume an open position and a closed position;

a second mastless umbrella structure including a second upper hub, a second lower hub, a plurality of ribs connected in a hinged manner to the second upper hub and cooperating with the tent canvas, and a plurality of counter-ribs, each counter-rib of the second umbrella structure having a first end part connected in a hinged manner to one of the ribs of said second umbrella structure and a second end part connected in a hinged manner to the second lower hub, the ribs and counter-ribs of the second umbrella structure being arranged such that the second lower hub is movable relative to the second upper hub along a second direction of movement, said second umbrella structure being able to assume an open position and a closed position; and at least a first junction configured to connect in a hinged manner a distal end of a first rib of the first umbrella structure and a distal end of a first rib of the second umbrella structure, a first counter-rib of the first umbrella structure having a first end part connected in a hinged manner to said first rib of said first umbrella structure and a second end part connected in a hinged manner to the first lower hub, the tent being able to assume a deployed position in which the first and second umbrella structures are in the open position and a folded position in which the first and second umbrella structures are in the closed position, the first rib of the first umbrella structure comprising a first rib portion, a second rib portion and a first hinge connecting said first and second rib portions pivotally about an axis transverse to said first and second rib portions, said first umbrella structure being configured to bring the second rib portion of its first rib into an unfolded position, when the first umbrella structure is brought into the deployed position, and to bring the second rib portion of its first rib in a folded down position, when the first umbrella structure is brought into the folded position, the first rib of the second umbrella structure comprising a first rib portion, a second rib portion and a second hinge connecting said first and second rib portions pivotally about an axis transverse to said first and second rib portions, said second umbrella structure being configured to bring the second rib portion of its first rib into an unfolded position, when the second umbrella structure is brought into the deployed position, and to bring the second rib portion of its first rib in a folded down position, when the second umbrella structure is brought into the folded position, said at least a first junction being configured to connect in a hinged manner the second rib portion of the first rib of the first umbrella structure and the second rib portion of the first rib of the second umbrella structure.

2. The foldable tent according to claim 1, wherein the second direction of movement is inclined with respect to the first direction of movement when the foldable tent is placed in the deployed position.

3. The foldable tent according to claim 1, wherein the first and second umbrella structures extend on either side of a vertical plane passing through the first junction, when the foldable tent is placed in the deployed position and rests on the ground.

4. The foldable tent according to claim 1, wherein the first junction comprises a first sheath configured to receive the distal ends of the first ribs of the first and second umbrella structures.

5. The foldable tent according to claim 1, wherein said first hinge is configured to limit the pivoting of the second rib portion of the first rib of the first umbrella structure relative to the first rib portion of the first rib of the first umbrella structure when said second rib portion is unfolded.

6. The foldable tent according to claim 1, comprising an interior volume defined by the first and second umbrella structures, when placed in the deployed position, and wherein said first hinge is configured to move towards the interior volume when the first umbrella structure is brought from its open position towards its closed position.

7. The foldable tent according to claim 1, wherein the tent canvas is connected to said first hinge.

8. The foldable tent according to claim 1, wherein the roof comprises at least a second junction configured to connect in a hinged manner a distal end of a second rib of the first structure umbrella and a distal end of a second rib of the second umbrella structure.

9. The foldable tent according to claim 8, wherein the first and second umbrella structures each comprise third and fourth ribs each having a distal end configured to rest on the ground when the foldable tent is placed in the deployed position.

10. The foldable tent according to claim 9, wherein the first umbrella structure comprises a fifth rib having a distal end cooperating with a cooperation portion of the tent canvas, the fifth rib having a length smaller than the length of the third and fourth ribs of the first umbrella structure and extending between said third and fourth ribs.

11. The foldable tent according to claim 1, wherein the ribs of the first umbrella structure each have a distal end, the tent canvas cooperating with said distal ends.

12. The foldable tent according to claim 11, wherein the first and second umbrella structures each comprise third and fourth ribs each having a distal end configured to rest on the ground when the foldable tent is placed in the deployed position, and wherein the tent canvas has a peripheral edge, and wherein said peripheral edge is connected to the distal ends of said third and fourth ribs of the first umbrella structure.

13. The foldable tent according to claim 1, wherein the first lower hub has a diameter smaller than the diameter of the first upper hub.

14. The foldable tent according to claim 1, wherein the first upper hub has a through orifice, wherein the first umbrella structure further includes an actuating element fastened to the first lower hub and passing through the orifice, whereby the first umbrella structure is brought into the open position by exerting traction on the actuating element from the outside of the foldable tent, so as to bring the first lower hub closer to the first upper hub in order to cause deployment of the ribs.

15. The foldable tent according to claim 1, wherein the first and second umbrella structures each comprise third and fourth ribs each having a distal end configured to rest on the ground when the foldable tent is placed in the deployed position, and wherein the roof of the foldable tent is shaped such that a tension line is formed on the tent canvas between the distal end of the third rib of the first umbrella structure and the hinge of the first rib of the second umbrella structure, when the first umbrella structure is open.

16. A foldable tent comprising a roof having:

a tent canvas;

a first umbrella structure including a first upper hub, a first lower hub, a plurality of ribs connected in a hinged manner to the first upper hub and cooperating with the tent canvas, and a plurality of counter-ribs, each counter-rib of the first umbrella structure having a first end part connected in a hinged manner to one of the ribs of said first umbrella structure and a second end part connected in a hinged manner to the first lower hub, the ribs and counter-ribs of the first umbrella structure being arranged such that the first lower hub is movable relative to the first upper hub along a first direction of movement, said first umbrella structure being able to assume an open position and a closed position;

a second umbrella structure including a second upper hub, a second lower hub, a plurality of ribs connected in a hinged manner to the second upper hub and cooperating with the tent canvas, and a plurality of counter-ribs, each counter-rib of the second umbrella structure having a first end part connected in a hinged manner to one of the ribs of said second umbrella structure and a second end part connected in a hinged manner to the second lower hub, the ribs and counter-ribs of the second umbrella structure being arranged such that the second lower hub is movable relative to the second upper hub along a second direction of movement, said second umbrella structure being able to assume an open position and a closed position;

at least a first junction configured to connect in a hinged manner a distal end of a first rib of the first umbrella structure and a distal end of a first rib of the second umbrella structure, the first rib of the first umbrella structure comprising a first rib portion, a second rib portion and a first hinge connecting said first and second rib portions pivotally about an axis transverse to said first and second rib portions, the first rib of the second umbrella structure comprising a first rib portion, a second rib portion and a second hinge connecting said first and second rib portions pivotally about an axis transverse to said first and second rib portions, said at least a first junction being configured to connect in a hinged manner the second rib portion of the first rib of the first umbrella structure and the second rib portion of the first rib of the second umbrella structure; and a second junction configured to connect in a hinged manner a distal end of a second rib of the first umbrella structure and a distal end of a second rib of the second umbrella structure.

17. The foldable tent according to claim 16, the tent being able to assume a deployed position in which the first and second umbrella structures are in the open position and a folded position in which the first and second umbrella structures are in the closed position.

18. The foldable tent according to claim 16, wherein the first junction comprises a first sheath configured to receive the distal ends of the first ribs of the first and second umbrella structures.

19. A foldable tent comprising a roof having:

a tent canvas;

a first umbrella structure including a first upper hub, a first lower hub, a plurality of ribs connected in a hinged manner to the first upper hub and cooperating with the tent canvas, and a plurality of counter-ribs, each counter-rib of the first umbrella structure having a first end part connected in a hinged manner to one of the ribs of said first umbrella structure and a second end part connected in a hinged manner to the first lower hub, the ribs and counter-ribs of the first umbrella structure being arranged such that the first lower hub is movable relative to the first upper hub along a first direction of movement, said first umbrella structure being able to assume an open position and a closed position;

a second umbrella structure including a second upper hub, a second lower hub, a plurality of ribs connected in a hinged manner to the second upper hub and cooperating with the tent canvas, and a plurality of counter-ribs, each counter-rib of the second umbrella structure having a first end part connected in a hinged manner to one of the ribs of said second umbrella structure and a second end part connected in a hinged manner to the second lower hub, the ribs and counter-ribs of the second umbrella structure being arranged such that the second lower hub is movable relative to the second upper hub along a second direction of movement, said second umbrella structure being able to assume an open position and a closed position;

at least a first junction configured to connect in a hinged manner a distal end of a first rib of the first umbrella structure and a distal end of a first rib of the second umbrella structure; and at least a second junction configured to connect in a hinged manner a distal end of a second rib of the first structure umbrella and a distal end of a second rib of the second umbrella structure, the first and second umbrella structures each comprising third and fourth ribs each having a distal end configured to rest on the ground when the foldable tent is placed in a deployed position, the first umbrella structure comprising a fifth rib having a distal end cooperating with a cooperation portion of the tent canvas, the fifth rib having a length smaller than the length of the third and fourth ribs of the first umbrella structure and extending between said third and fourth ribs.

20. A foldable tent comprising a roof having:

a tent canvas;

a first umbrella structure including a first upper hub, a first lower hub, a plurality of ribs connected in a hinged manner to the first upper hub and cooperating with the tent canvas, and a plurality of counter-ribs, each counter-rib of the first umbrella structure having a first end part connected in a hinged manner to one of the ribs of said first umbrella structure and a second end part connected in a hinged manner to the first lower hub, the ribs and counter-ribs of the first umbrella structure being arranged such that the first lower hub is movable relative to the first upper hub along a first direction of movement, said first umbrella structure being able to assume an open position and a closed position;

a second umbrella structure including a second upper hub, a second lower hub, a plurality of ribs connected in a hinged manner to the second upper hub and cooperating with the tent canvas, and a plurality of counter-ribs, each counter-rib of the second umbrella structure having a first end part connected in a hinged manner to one of the ribs of said second umbrella structure and a second end part connected in a hinged manner to the second lower hub, the ribs and counter-ribs of the second umbrella structure being arranged such that the second lower hub is movable relative to the second upper hub along a second direction of movement, said second umbrella structure being able to assume an open position and a closed position; and at least a first junction configured to connect in a hinged manner a distal end of a first rib of the first umbrella structure and a distal end of a first rib of the second umbrella structure, the first rib of the first umbrella structure comprising a first rib portion, a second rib portion and a hinge connecting said first and second rib portions pivotally about an axis transverse to said first and second rib portions, said first umbrella structure being configured to bring the second rib portion into an unfolded position, when the first umbrella structure is brought into a deployed position, and to bring the second rib portion in a folded down position, when the first umbrella structure is brought into a folded position, wherein the first rib of the second umbrella structure comprises a first rib portion, a second rib portion and a hinge pivotally connecting said first and second rib portions, wherein the first and second umbrella structures each comprise third and fourth ribs each having a distal end configured to rest on the ground when the foldable tent is placed in the deployed position, and wherein the roof of the foldable tent is shaped such that a tension line is formed on the tent canvas between the distal end of the third rib of the first umbrella structure and the hinge of the first rib of the second umbrella structure, when the first umbrella structure is open.

* * * * *